United States Patent [19]

Hartopp

[11] 4,091,786

[45] May 30, 1978

[54] DEVICE FOR REGULATING FUEL INTAKE OF INTERNAL COMBUSTION ENGINES

[75] Inventor: George Albert Hartopp, Leicester, England

[73] Assignees: John Albert Hartopp; Rita Alberta Jones, both of Leicester, England

[21] Appl. No.: 763,918

[22] Filed: Jan. 31, 1977

[30] Foreign Application Priority Data

Feb. 3, 1976 United Kingdom ..... 4206/76

[51] Int. Cl.[2] ..... F02M 29/00

[52] U.S. Cl. ..... 123/141; 261/78 R; 48/180 R

[58] Field of Search ..... 123/141; 261/78 R; 48/180 R

[56] References Cited

U.S. PATENT DOCUMENTS

| | | | |
|---|---|---|---|
| 1,061,655 | 5/1913 | Bachman | 123/141 |
| 1,394,820 | 10/1921 | Fritz | 123/141 |
| 3,544,290 | 12/1970 | Larson et al. | 123/141 |
| 3,615,296 | 10/1971 | Guarnaschelli | 123/141 X |
| 3,682,608 | 8/1972 | Hicks | 123/119 E |
| 3,934,569 | 1/1976 | Bobene | 123/141 |
| 4,015,575 | 4/1977 | Fox | 123/141 |

*Primary Examiner*—Charles J. Myhre
*Assistant Examiner*—Ira S. Lazarus
*Attorney, Agent, or Firm*—Cohn, Powell & Hind

[57] ABSTRACT

A flow regulating device, for insertion in an air fuel intake pipe of an internal combustion engine, comprising a sheet metal support having a number of cut-out portions therein so as to define, for the support, a peripheral mounting portion, an annular central portion having a central aperture and web portions between the mounting portion and the central portion for locating and supporting the central portion, and a metal gauze sheet secured to the sheet metal support covering the cut-out portions with a central aperture in the gauze sheet coincident with the central aperture in the sheet metal support.

5 Claims, 2 Drawing Figures

DEVICE FOR REGULATING FUEL INTAKE OF INTERNAL COMBUSTION ENGINES

The invention relates to air flow regulating devices and provides a device for insertion in the air fuel intake pipe of an internal combustion engine for regulating the flow of intake gases to the engine. By means of a flow regulating device according to the invention it is possible to decrease the fuel consumption of an internal combustion engine, to increase the responsiveness of the engine, to facilitate cold starting and/or to decrease the air pollution caused by the exhaust gases.

The invention provides a flow regulating device, for insertion in an air fuel intake pipe of an internal combustion engine, comprising a sheet metal support having a number of cut-out portions therein so as to define, for the support, a peripheral mounting portion, an annular central portion having a central aperture and web portions between the mounting portion and the central portion for locating and supporting the central portion, and a metal gauze sheet secured to the sheet metal support covering the cut-out portions with a central aperture in the gauze sheet coincident with the central aperture in the sheet metal support.

In use the device according to the invention is placed in the art fuel intake pipe of an internal combustion engine, conveniently at the junction between a carburettor and an intake manifold. Such a junction generally has a gasket under or over which the device can be placed. The peripheral mounting portion of the sheet metal support is preferably shaped so as to cooperate with any bolt holes in flanges of the carburettor and inlet manifold so that central mounting of the device is facilitated. Alternatively one or more such devices may be fitted between the inlet manifold and the engine block.

After fitting a device according to the invention to an internal combustion engine it will generally be found that the idling speed of the engine has increased, indicating a more efficient use of the fuel. An adjustment to the idling speed control screw will readily re-establish normal tick-over.

It seems probable that the more efficient use of fuel that can be attained using a device according to the invention is a result at least in part of a reduction in turbulence in the fuel and air mixture supplied to the engine. The gauze and web portions of the device according to the invention present a partial flow restriction around the periphery of the inlet pipe or inlet manifold, with no such restriction at the centre. A flow gradient is therefore established which appears to result in better, or more uniform, filling of the firing chambers of the engine. The annular central portion of the device, if too wide, would interfere with this flow gradient. The central portion should therefore be a narrow annulus, of sufficient width to support the gauze against the often high air flow therethrough. It has been found that web portions that occupy about 8% of the cross-section of the inlet pipe in which the device is placed produce a significantly improved engine performance.

The device of the invention is simpler in construction than the majority of prior proposed fuel supply regulators and yet surprisingly provides an appreciable and wide-ranging improvement in engine performance. It has been found that it can provide an appreciable improvement in fuel consumption after re-tuning the engine to suit the modified fuel mixture reaching the cylinders. In addition, and possibly providing the cause of the fuel consumption improvement, it will be found that there is a substantial equalization of the fuel compression in the various cylinders. Instead of one cylinder receiving a far greater compression than the others and doing a greater share of the work, as frequently happens in internal combustion engines, the device of the invention helps to spread the fuel compression more evenly between the different cylinders.

Most surprisingly, it has been found that the device of the invention produces a significant reduction in the carbon monoxide content of the engine exhaust emission. Under laboratory test conditions, this reduction was found to be by more than 50% at engine idling speeds.

The device may be fitted to either 2-stroke or 4-stroke piston engines.

The invention is illustrated by the drawings of which:

Figure 1:
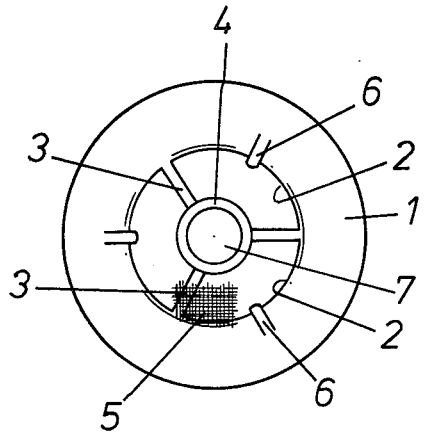
FIG. 1 is a top view of a device according to the invention.
Figure 2:
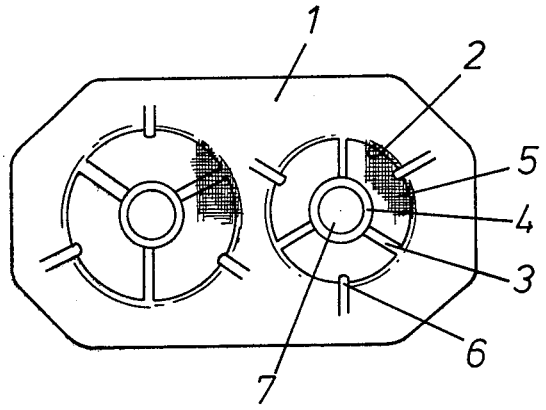
FIG. 2 is a top view of an alternative form of the device for use in an engine with a twin-feed carburettor.

The device of FIGS. 1 and 2 differs only in that the device of FIG. 2 is for use in an engine in which there are parallel air fuel supply pipes from the carburettor to the engine. The device of FIG. 2 is therefore equivalent to two devices according to FIG. 1, placed side-by-side and formed from a single sheet metal support and a single gauze sheet. For convenience, only the device of FIG. 1 is described below, the same reference numerals being used for identical parts in FIG. 2.

In FIG. 1, a stainless steel sheet metal support 1 is of a shape and size to enable it to fit between the carburettor and intake manifold of a motor vehicle engine. Cut-out portions 2 define three web portions 3, spaced 120° apart, supporting an annular central portion 4. A stainless steel gauze sheet 5 is supported at its outer periphery by bent-over flanges 6 of the support 1 and covers the whole of the cut-out portions 2. A central aperture 7 is formed through the gauze sheet 5, which is supported around the periphery of the aperture by means of a bent-over flanged portion of the annular central portion 4. The flanged portion encases the periphery of the aperture 7 and provides valuable protection against corrosion of the gauze sheet 5 at its inner periphery.

Typical dimensions are as follows, being by way of example only:

Thickness of stainless steel sheet 1:
0.017 to 0.022 inches
Diameter of central aperture 7:
0.375 to 0.400 inches
Gauze: WIRE: 0.020 inches; 25 to 30 meshes per inch.

I claim:

1. A flow regulating device for insertion in an air fuel intake pipe of an internal combustion engine, comprising sheet metal support, a number of cut-out portions in the support defining, for the support, a peripheral mounting portion, an annular central portion, a central aperture in the central portion and web portions between the mounting portion and the central portion, a metal gauze sheet overlying the sheet metal support and the cut-out portions therein said gauze sheet being in close contact with said web portions for selective masking by said web portions, means securing the metal gauze sheet to the sheet metal support, and a central aperture in the metal gauze sheet coincident with the central aperture in the sheet metal support said apertures providing a free and uninterrupted air passage through the device.

2. A device according to claim 1, wherein the sheet metal support is a flat sheet of stainless steel of thickness 0.017 inches to 0.022 inches.

3. A device according to claim 2, wherein the diameter of the coincident central apertures is 0.375 inches to 0.400 inches.

4. A device according to claim 1, wherein the web portions together occupy about 8% of the area of the cut-out portions.

5. A device according to claim 1, wherein the web portions and the annular central portion of the sheet metal support are unitarily formed and said central portion is bent over as a flange over the edge of the central aperture in the gauze.

* * * * *